US006310529B1

(12) United States Patent
Luetzow et al.

(10) Patent No.: US 6,310,529 B1
(45) Date of Patent: Oct. 30, 2001

(54) BI-STABLE BATTERY SWITCH

(75) Inventors: Edwin J. Luetzow; Richard L. Luetzow, both of Brookings, SD (US)

(73) Assignee: MTR, Inc., Brookings, SD (US)

( * ) Notice: Subject to any disclaimer, the term of this patent is extended or adjusted under 35 U.S.C. 154(b) by 0 days.

(21) Appl. No.: 09/559,679

(22) Filed: Apr. 27, 2000

(51) Int. Cl.[7] ..... H01H 3/00

(52) U.S. Cl. ..... 335/185; 335/106; 335/127; 335/133; 335/135; 335/189; 335/190; 200/573

(58) Field of Search ..... 335/106, 127, 335/128, 133, 135, 156, 185, 189, 190; 307/143; 200/573

(56) References Cited

U.S. PATENT DOCUMENTS 4,430,579 * 2/1984 Wiktor ..... 307/134

* cited by examiner

*Primary Examiner*—Ramon M. Barrera
(74) *Attorney, Agent, or Firm*—Hugh D. Jaeger

(57) ABSTRACT

The present invention is for a bi-stable battery switch incorporated preferably for internal use into a remotely switchable storage battery, or, in the alternative, for external use with a battery. A bifurcated contact assembly incorporating dual bus bars is pulse actuated by a solenoid and cam arrangement to engage or disengage across opposing contacts. When engaging the contacts and when associated with high inductive loads, the first bus bar to advance initiates contact and assumes the arcing load, while the second bus bar to advance assumes the current load. When breaking contact and when associated with high inductive loads, the first bus bar to retreat breaks the current load and the second bus bar to retreat breaks the arcing load. Thus, the loads are shared to increase the durability and length of service of the switch.

6 Claims, 17 Drawing Sheets

BI-STABLE BATTERY SWITCH

CROSS REFERENCES TO CO-PENDING APPLICATIONS

None.

BACKGROUND OF THE INVENTION

1. Field of the Invention

The present invention is for a battery switch, and more particularly, pertains to a bi-stable battery switch incorporated preferably for internal use into a remotely switchable storage battery, or, in the alternative, for external use with a battery.

2. Description of the Prior Art

Remotely switchable storage batteries, such as for use in, but not limited to, an automobile, have been offered for use as an anti-theft deterrent. A switch is contained in a battery and is operated remotely by a small hand-held remote transmitting device. An individual merely activates the remote transmitting device whereby a receiver located in the battery case is activated to trigger the disconnection of the battery circuit internally within the battery case, thereby removing available battery power to the circuits residing in the automobile such as, for example, and which may be highly inductive loads, ignition modules, starters, generators, alternators, fans and the like. Such disconnection electrically disables the automobile, or other vehicle in which the remotely switchable storage battery is installed. Often, operators of the vehicle would decide to remotely shut down and disable the vehicle with the vehicle still running as an alternative to first turning off the vehicle. Using this method, high inductive loads are still operative at the instant of remote electrical disablement. In the presence of the high inductive loads during remote shutdown, prior art switching methods, particularly with respect to the electrical switching contacts, caused excessive arcing across the switching contacts during shutdown. Excessive arcing across breaking or making electrical contacts is an undesirable trait present when breaking or making an inductive load and often causes premature degradation of the surfaces of the electrical contacts, thereby causing contact or switch failure. Remote reconnection and enabling of the remotely switchable storage battery provides an imposition of inductive loads across the switch contacts, also causing undesirable contact arcing leading to premature failure of the contacts.

Clearly what is needed is a switching device which overcomes the flaws and deficiencies of the prior art.

SUMMARY OF THE INVENTION

The general purpose of the present invention is a bi-stable battery switch for incorporation into or about a remotely switchable storage battery. The bi-stable battery switch in general is a double bar bus switch in which a solenoid pulses a cam which in turn actuates or de-actuates two parallel circuit spring loaded positionable bus bars comprising a bifurcated contact assembly to either break or make an electrical connection across adjacent and aligned stationary and wide V-shaped contacts located on switch terminals. Each of the positionable bus bars is cam operated or influenced and is in the form of a movable bar having two contacts located thereupon, each contact having an arced surface. During the making of an electrical contact to connect the battery to the electrical system of an automobile, the direct influence of a cam is eliminated to allow spring forces to urge the two spring loaded positionable bus bars of the bifurcated contact assembly into near simultaneous dual contact with and across the wide stationary V-shaped contacts of the switch terminals. Although both positionable bus bars are springingly and simultaneously urged toward and into intimate dual contact with the stationary and wide contacts located on the switch terminals, one positionable bus bar precedes, in a very short time span, the adjoining positionable bus bar and picks up the arcing load in contacting the wide contacts of the switch terminals only to be closely followed by the remaining positionable bus bar which in contacting the wide contacts of the switch terminals picks up the current load.

According to one or more embodiments of the present invention there is provided a bi-stable battery switch for use with and for incorporation into internal use with a remotely switchable storage battery, or, in the alternative, for external use with a battery. The bi-stable battery switch is built about and within a substantially rectangular enclosure having a top and a bottom to which components align and secure. Located in the rectangular enclosure is a vertically aligned cam and associated members which are actuated by a cam driver arm connected to the solenoid core. Adjacent to the vertically aligned cam is a bifurcated contact assembly having two spring loaded positionable bus bars which are aligned to and actuated by the vertically aligned cam. A large switch terminal and a small switch terminal, each having wide V-shaped contacts which are sized to contact the arc-shaped contacts on both positionable bus bars, align to the bifurcated contact assembly to either make or break contacts thereupon.

One significant aspect and feature of the present invention is a bi-stable battery switch which exhibits a long life.

Another significant aspect and feature of the present invention is a bi-stable battery switch having a bifurcated contact assembly having an upper and a lower bus bar.

Still another significant aspect and feature of the present invention is a bi-stable battery switch where a cam arrangement is used in pulse fashion to cause advancing or retarding of a bifurcated contact assembly.

Yet another significant aspect and feature of the present invention is the incorporation of upper and lower bus bars whereby inductive loads are distributed along both the upper and lower bus bars. In making of the contacts, the first to accept an inductive load accepts an arcing load while the second to accept an inductive load accepts a current load; while in breaking of the contacts, the first to shed an inductive load sheds a current load and the second to shed an inductive load sheds an arcing load.

Having thus described an embodiment of the present invention and specified significant aspects and features thereof, it is the principal object of the present invention to provide a bi-stable battery switch.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENT

Figure 1:
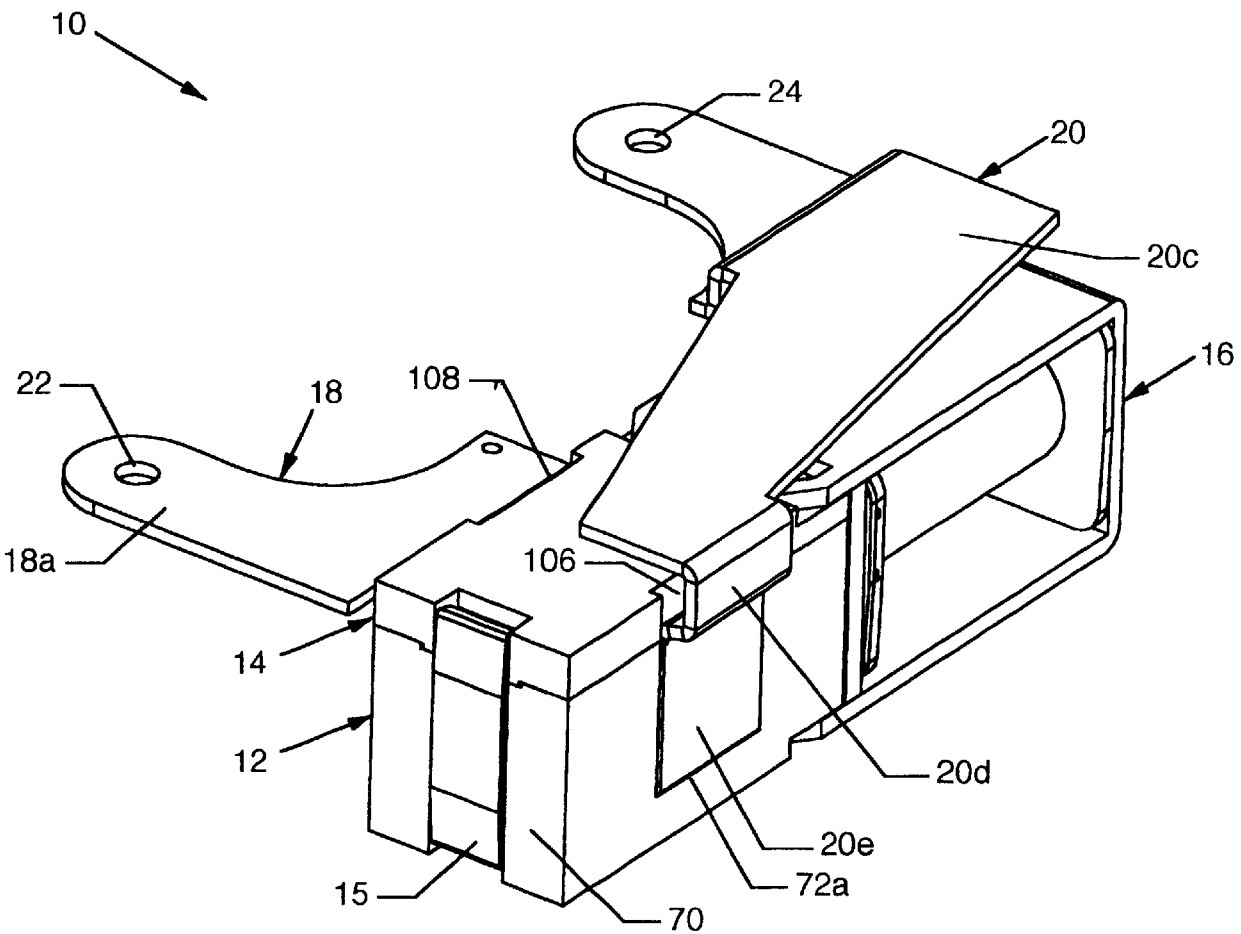
FIG. 1 illustrates an isometric view of a bi-stable battery switch, the present invention.

FIG. 1 illustrates an isometric view of a bi-stable battery switch 10, the present invention. Visible in the illustration is a rectangular enclosure bottom 12 mated with a substantially planar enclosure top 14, a clip 15 extending between and securing one end of the enclosure top 14 to one end of the enclosure bottom 12, a solenoid 16 mated and attached to one end of the enclosure top 14 and one end of the enclosure bottom 12 and securing them together, a large configured switch terminal 20 located over and about the solenoid 16 and a portion of the enclosure top 14 and extending both downwardly and inwardly to a location between the enclosure top 14 and the enclosure bottom 12, a small configured switch terminal 18 in opposition to the large switch terminal 20 extending downwardly and inwardly to a location between the enclosure top 14 and the enclosure bottom 12, and, attachment holes 22 and 24 located at the ends of the small switch terminal 18 and the large switch terminal 20, respectively.

Figure 2:
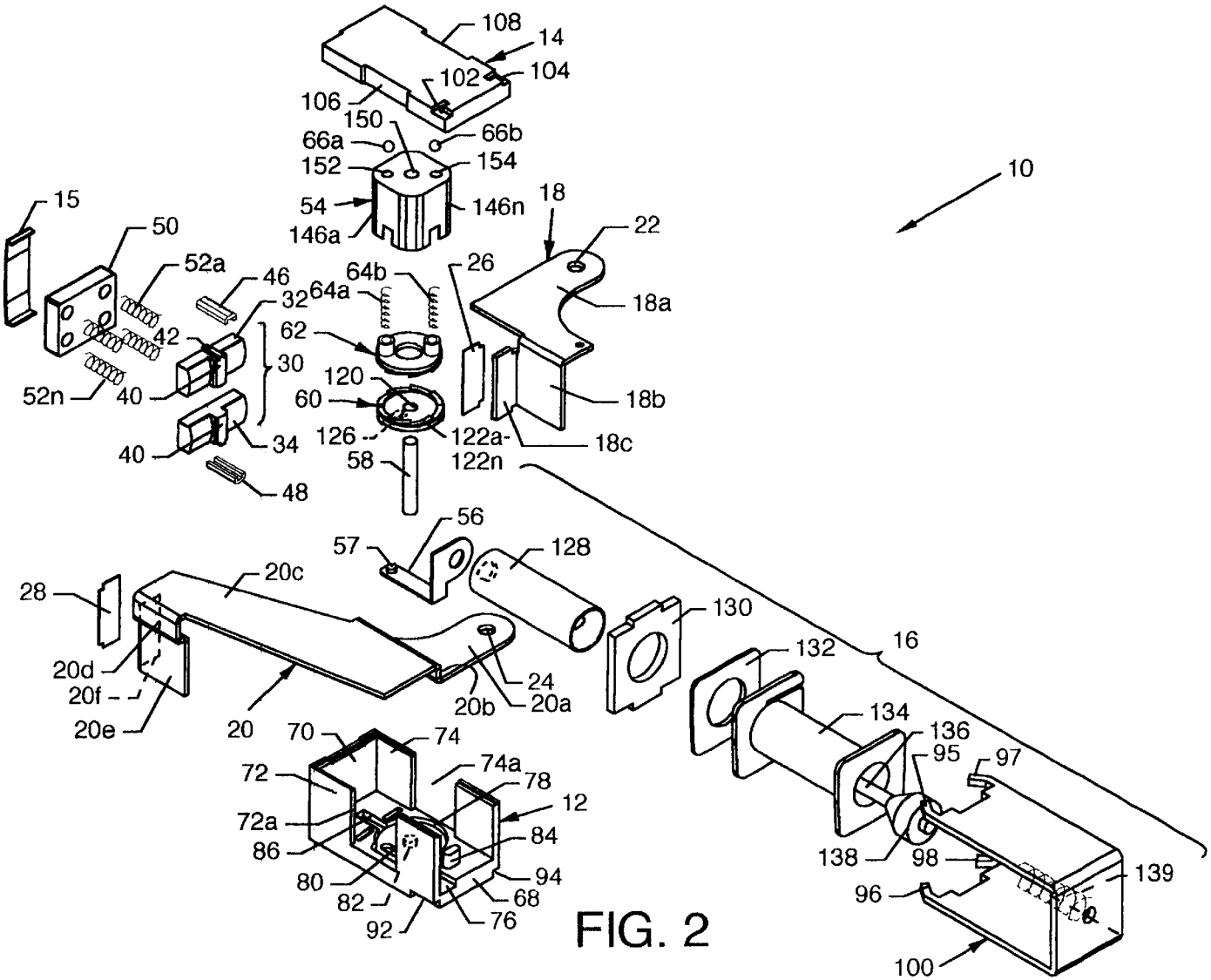
FIG. 2 illustrates an exploded isometric view of the bi-stable battery switch.

FIG. 2 illustrates an exploded isometric view of the bi-stable battery switch 10, where all numerals previously mentioned correspond to those elements previously described. With reference to FIG. 2 and with implied reference to other figures showing the invention, components of the bi-stable battery switch 10 and their relationship is now described. The small switch terminal 18, also shown in FIG. 3, includes a horizontally oriented planar structure 18*a*, a vertically oriented planar structure 18*b* extending downwardly from horizontally oriented planar structure 18*a*, and a planar contact mounting pad 18*c* extending at a right angle and inwardly from the vertically oriented planar structure 18*b*. A dual and continuous contact 26 having juxtaposed wide V-shaped contact surface arrangements (FIG. 3) secures to one side of the contact mounting pad 18*c*. Correspondingly, the large switch terminal 20, also shown in FIG. 4, includes a horizontally oriented planar structure 20*a*, a small vertically oriented planar structure 20*b* extending upwardly from the horizontally oriented planar structure 20*a*, a horizontally oriented planar structure 20*c* extending horizontally from the vertically oriented planar structure 20*b*, a U-shaped structure 20*d* extending downwardly from the horizontally oriented planar structure 20*c*, a vertically oriented planar structure 20*e* extending downwardly from the U-shaped structure 20*d*, and a planar contact mounting pad 20*f* (FIG. 4) extending at a right angle and inwardly from the vertically oriented planar structure 20*e*. A dual and continuous contact 28 having juxtaposed wide V-shaped contact surface arrangements (FIG. 4) secures to one side of the contact mounting pad 20*f*.

Figure 5:
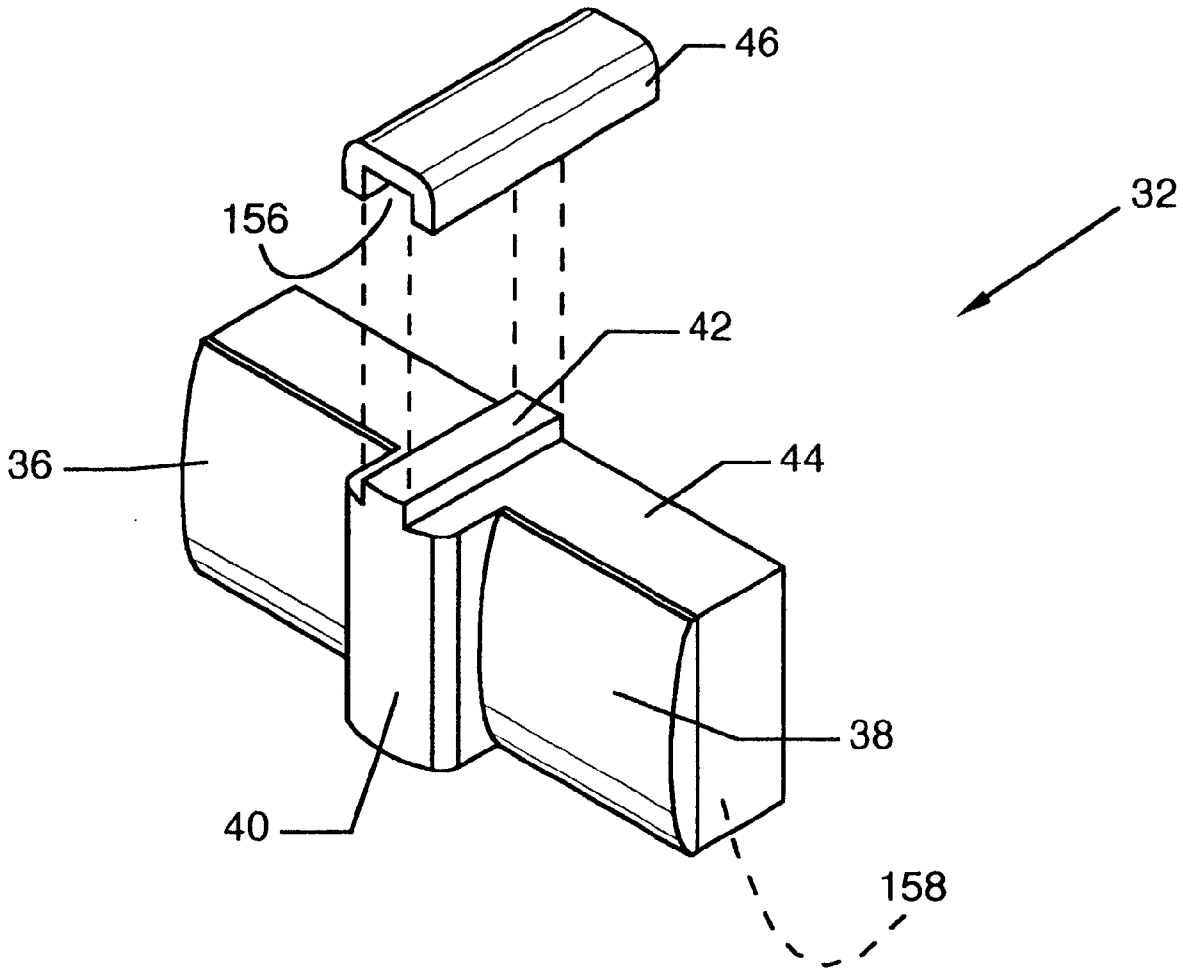
FIG. 5 illustrates an isometric view of the upper bus bar and a contact guide.

Located in close proximity and alignment to the contacts 26 and 28 is a bifurcated contact assembly 30 having identical but mutually inverted and opposing spring loaded positionable upper and lower bus bars 32 and 34 located in close proximity and alignment for contacting of the contacts 26 and 28. As shown in FIG. 5, the upper bus bar 32, and thus also the identical lower bus bar 34, includes opposing arc-shaped contacts 36 and 38, a cam surface 40 disposed vertically between the opposing arc-shaped contacts 36 and 38, and, a guide bar 42 located on a planar surface 44 and at a right angle to the cam surface 40. Upper and lower channel-shaped contact guides 46 and 48 interface between the upper and lower bus bars 32 and 34 and the enclosure top 14 and the enclosure bottom 12, respectively, as later described in detail. A rectangular spring holder 50 serves as a base for a plurality of springs 52*a*–52*n* whose purpose is to provide inwardly directed pressure to position the upper and lower bus bars 32 and 34 into electrical contact with and across the contacts 26 and 28 when allowed by the position of a cam 54.

The enclosure bottom 12 and the enclosure top 14 together form an enclosure to which components align and secure about and within, including, but not limited to, the bifurcated contact assembly 30, the rectangular spring holder 50 and springs 52*a*–52*n*, the upper and lower contact guides 46 and 48, the small switch terminal 18, the large switch terminal 20, the solenoid 16, a solenoid operated cam driver arm 56, and the cam 54 and associated members. The cam 54 and the associated members including a cam pivot pin 58, a cam driver 60, a carrier driver 62, springs 64*a* and 64*b*, and balls 66*a* and 66*b* are located and/or secured between the enclosure bottom 12 and the enclosure top 14 each of which includes suitable geometrical configurations to accommodate the cam 54 and associated cam related members as well as other elements of the invention.

The enclosure bottom 12 (FIG. 6) includes a substantially planar bottom 68, a vertically aligned end 70, an open end opposing the end 70, and a vertically aligned left side 72 and right side 74. Cutouts 72*a* and 74*a* in the left and right sides 72 and 74 accommodate and support the vertically oriented planar structure 20*e* and the vertically oriented planar structure 18*b* of the small switch terminal 18 and the large switch terminal 20, respectively, which in part anchor the large switch terminal 20 and the small switch terminal 18. The bottom 68 includes geometrically configured recessed or other regions on its upper surface including a channeled recess 76 which intersects a circular recess 78, an elongated recess 80 located in the channeled recess 76, a circular recess 82 located central to the circular recess 78, an upwardly extending solenoid core stop 84, and a rectangular recess 86 for accommodation of the lower contact guide 48. Also included are rectangular recesses 88 and 90 for the accommodation of the combined lower ends of contact 28/contact mounting pad 20*f* and the combined lower ends of contact 26/contact mounting pad 18*c*, respectively, which can in part anchor the large switch terminal 20 and the small switch terminal 18. Geometrically configured capturing slots 92 and 94 are located on the underside of the bottom 68 for positive mating with the tabs 96 and 98 of the framework 100 of the solenoid 16.

The enclosure top 14 (shown inverted in FIG. 7) also includes geometrically configured capturing slots 102 and 104 located on the top surface for positive mating with tabs 95 and 97 of the framework 100 of the solenoid 16. Also included are recesses 106 and 108 for accommodation of portions of the vertically oriented planar structures 20*e* and 18*b* of the large switch terminal 20 and the small switch terminal 18. The enclosure top 14 includes geometrically configured recessed or other regions on its lower surface, some of which are similar to those found on the enclosure bottom 12, including a rectangular recess 110 for accommodation of the upper contact guide 46, rectangular recesses 112 and 114 for the accommodation of the combined upper ends of contact 28/contact mounting pad 20*f* and the combined lower ends of contact 26/contact mounting pad 18*c*, respectively, which can in part anchor the large switch terminal 20 and the small switch terminal 18. In addition, a circular recess 116 in opposition to circular recess 82 of the enclosure bottom 12 is located on the undersurface of the enclosure top 14. Together, circular recesses 116 and 82 serve as upper and lower mounts for the cam pivot pin 58. A series of detent grooves 118*a*–118*n* having ramped depth are located concentric to the circular recess 116.

The cam 54, and other associated components, are located along and about the vertically oriented cam pivot pin 58. The cam driver 60 (shown inverted in FIG. 8) is substantially disk-shaped and includes a centrally located hole 120 extending therethrough, a plurality of ratchet teeth 122*a*–122*n* on the upper side, a recessed portion 124 on the lower side, and an engagement hole 126 extending vertically through the cam driver 60 in the area of the recessed portion 124. The cam driver 60 aligns over and about and is allowed to be actuated about the cam pivot pin 58. The cam driver 60 freely aligns in the circular recess 78 in the bottom 68 of the enclosure bottom 12. Aligned in the channeled recess 76 of the enclosure bottom 12 is the cam driver arm 56 which includes a cam driver pin 57 extending vertically through and extending both above and below the cam driver arm 56. The lower end of the cam driver pin 57 is freely accommodated by the elongated recess 80 in the bottom 68 of the enclosure bottom 12 and the upper end of the cam driver pin 57 rotatingly engages the engagement hole 126. Hole 126 is slightly larger than the diameter of the cam driver pin 57 to allow for non-bonding engagement of the cam driver pin 57 with the hole 126, as hole 126 moves along an arcuate path during rotation about the cam pivot pin 58. The solenoid 16, which includes a solenoid core 128, a pole face 130, a spacer 132, a bobbin 134, a guide pin 136, a core stud assembly 138, a spring 139, and the framework 100, actuates the cam driver arm 56 to subsequently rotate the cam driver 60 in a counterclockwise fashion. Also aligned freely over and about the cam pivot pin 58 as well as aligned in intimate contact with the cam driver arm 56 is the carrier driver 62.

The cam driver 62 (also shown in FIG. 9) includes vertically aligned cylindrical spring mounts 140 and 142 extending from its top surface for mounting of the lower ends of the springs 64*a* and 64*b* and also includes a plurality of ratchet teeth 144*a*–144*n* located along and extending downwardly from the bottom surface. Ratchet teeth 144*a*–144*n* accommodatingly correspond to and intimately contact and positively engage (in one direction) the ratchet teeth 122*a*–122*n* on the upper surface of the cam driver 60. Positive engagement of ratchet teeth 122*a*–122*n* and ratchet teeth 144*a*–144*n* occurs in a counterclockwise manner when the cam driver arm 56 is actuated inwardly and to the right by the solenoid 16. Subsequent to this action and when power is interrupted to the solenoid 16, the recoiling action of the solenoid returns the cam driver arm 56 and thus the cam driver 60, by virtue of the slipping of the ratchet teeth 122*a*–122*n* with ratchet teeth 144*a*–144*n*, in the reverse direction, to the rest or non-actuated position after positioning of the carrier driver 62. Such cycling of the solenoid 16 provides for 45° counterclockwise rotational repositioning of the carrier driver 62 and of the attached cam 54. Such repositioning provides for repositioning of the bifurcated contact assembly 30 to either make or break electrical contact across the contacts 26 and 28.

Figure 10:
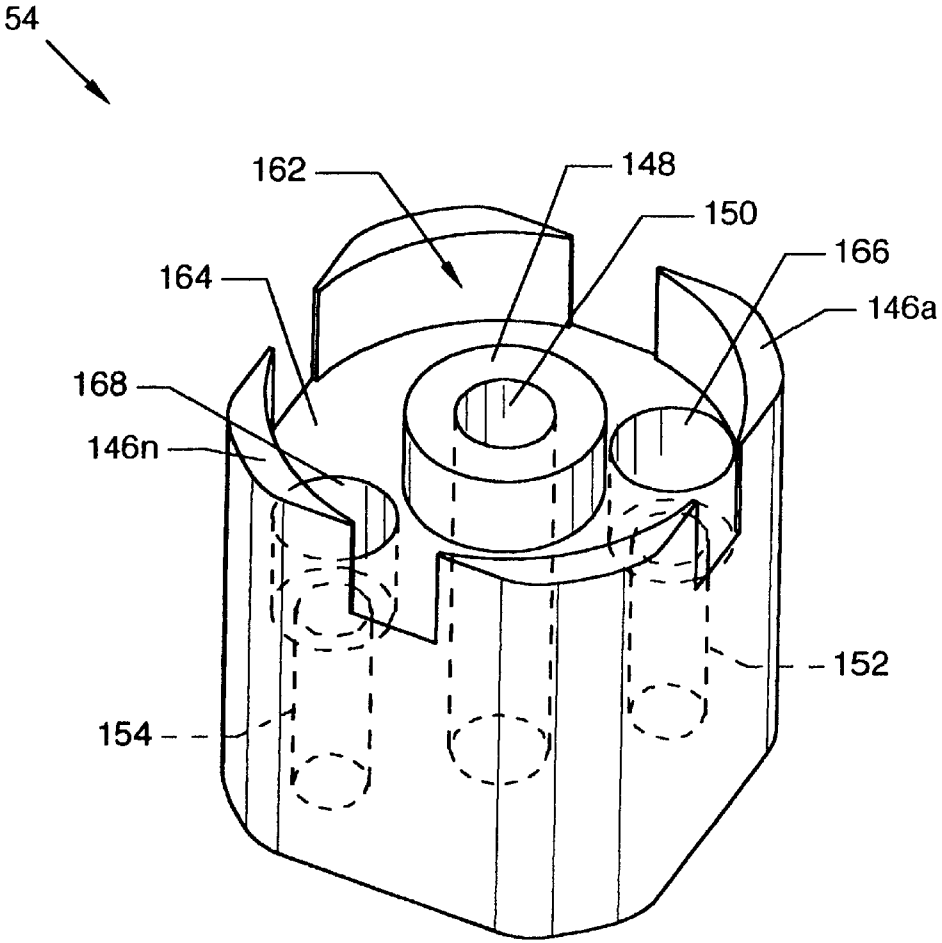
FIG. 10 illustrates an inverted isometric view of the cam.

The cam 54, shown inverted in FIG. 10, includes a plurality of vertically aligned cam lobes 146*a*–146*n* which align in parallel and concentric fashion to a centrally located annular centering extension 148 on the underside of the cam 54 and which also align in parallel and concentric fashion to a co-located pivot hole 150 extending through the body of the cam 54 and extending through the annular centering extension 148. Structure of the cam 54 and the relationship to the underlying structures is found in the description of FIG. 10. Also visible are the upper regions of spring bores 152 and 154 to which balls 66*a* and 66*b* align, respectively. The balls 66*a* and 66*b* interface between the cam 54 and the detent grooves 118*a*–118*n* of the enclosure top 14 (FIG. 7) to provide detented positional fixation for proper alignment of the cam 54 and to ensure that the cam 54 and the carrier driver 62 are not allowed to rotatingly regress and that they are held in their advanced position as the cam driver 60 returns to the unactuated position upon release of power application to the solenoid 16.

Figure 3:
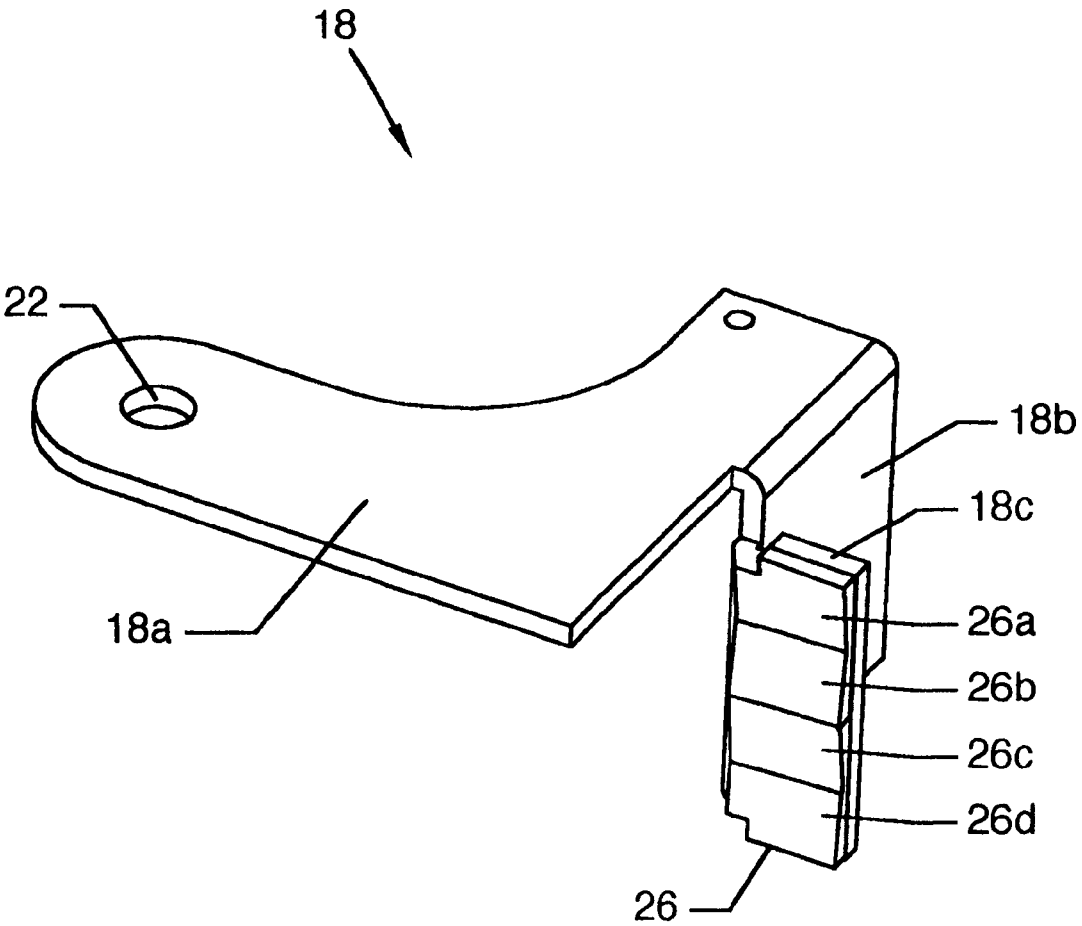
FIG. 3 illustrates an isometric view of the small switch terminal.

FIG. 3 illustrates an isometric view of the small switch terminal 18, where all numerals mentioned previously correspond to those elements previously described. Illustrated in particular is dual and continuous contact 26 having juxtaposed wide V-shaped contact surfaces including surfaces 26*a* and 26*b* which are angled and which mutually intersect and surfaces 26*c* and 26*d* which are angled and which mutually intersect. The surfaces 26*a* and 26*b* provide for multi-point contact with the arc-shaped contact 38 of the upper bus bar 32 and the surfaces 26*c* and 26*d* provide for multi-point contact with the arc-shaped contact 38 of the lower bus bar 34.

Figure 4:
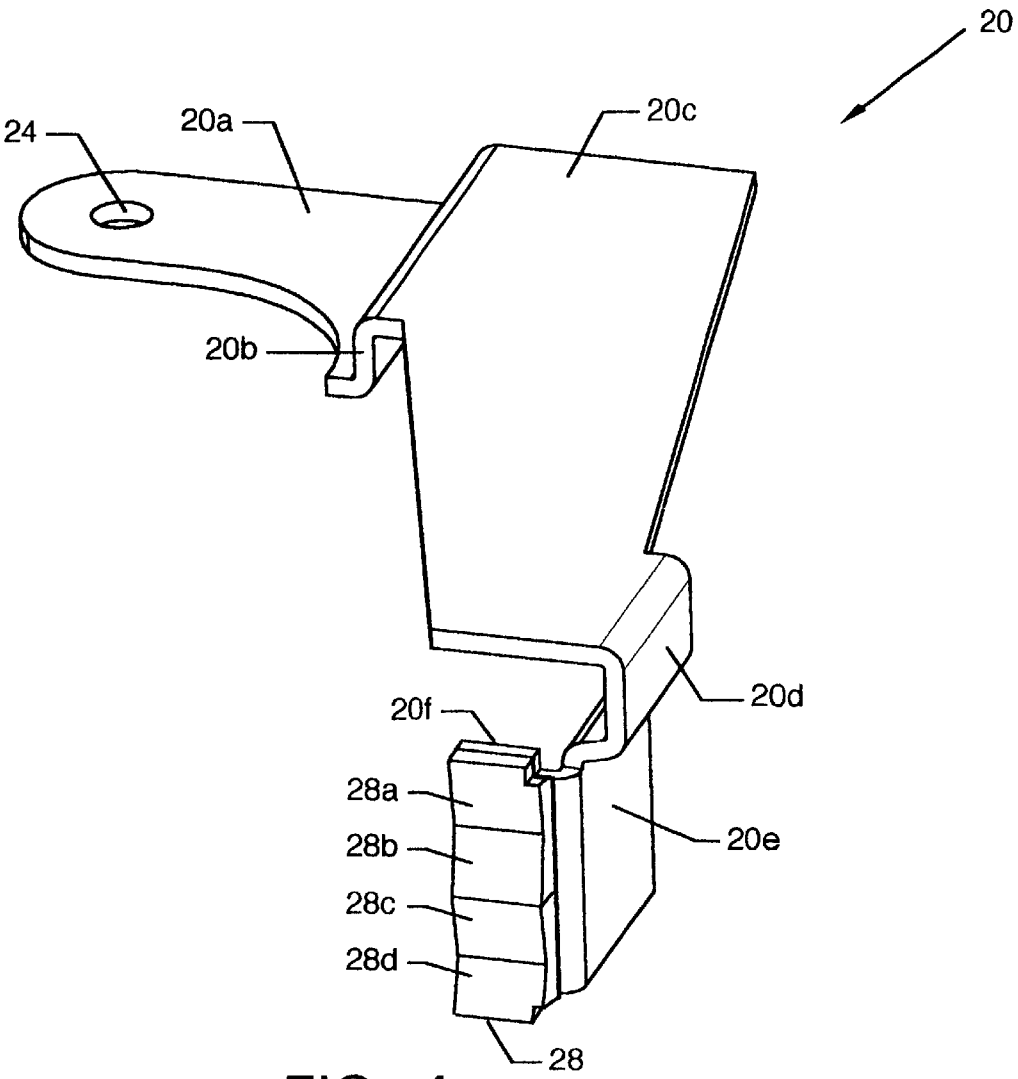
FIG. 4 illustrates an isometric view of the large switch terminal.

FIG. 4 illustrates an isometric view of the large switch terminal 20 where all numerals mentioned previously correspond to those elements previously described. Illustrated in particular is dual and continuous contact 28 having juxtaposed wide V-shaped contact surfaces including surfaces 28*a* and 28*b* which are angled and which mutually intersect and surfaces 28*c* and 28*d* which are angled and which mutually intersect. The surfaces 28*a* and 28*b* provide for multi-point contact with the arc-shaped contact 36 of the upper bus bar 32 and the surfaces 28*c* and 28*d* provide for multi-point contact with the arc-shaped contact 36 of the lower bus bar 34.

FIG. 5 illustrates an isometric view of upper bus bar 32, being identical to lower bus bar 34, where all numerals mentioned previously correspond to those elements previously described. A guide bar 42 is located transverse to the planar surface 44 at the top region of the bus bar 32. The guide bar 42 aligns in a channel 156 on one side of the upper contact guide 46, accommodatingly located in the rectangular recess 110 in the enclosure top 14, to facilitate to and fro movement of the upper bus bar 32. A similar arrangement exists between the lower bus bar 34, which is inverted, and the similarly constructed and inverted lower contact guide 48 accommodatingly located in the rectangular recess 86 in the enclosure bottom 12, to facilitate to and fro movement of the lower bus bar 34. It is noted that surface 158, which is located on the bottom of the upper bus bar 32, is smooth and comes into intimate and sliding contact with the corresponding smooth surface 158 of the inverted lower bus bar 34, thus allowing for and promoting independent sliding movement of the upper and lower bus bars 32 and 34, respectively.

Figure 6:
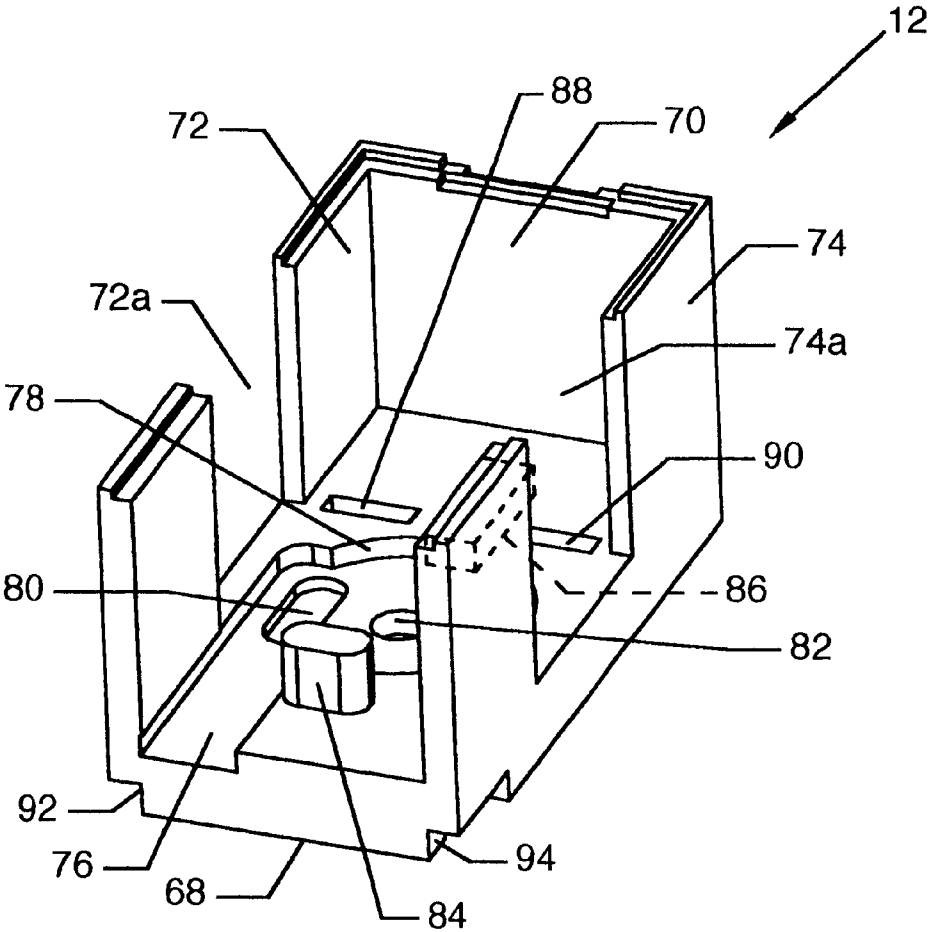
FIG. 6 illustrates an isometric view of the enclosure bottom.

FIG. 6 illustrates an isometric view of the enclosure bottom 12, where all numerals correspond to those elements previously described.

Figure 7:
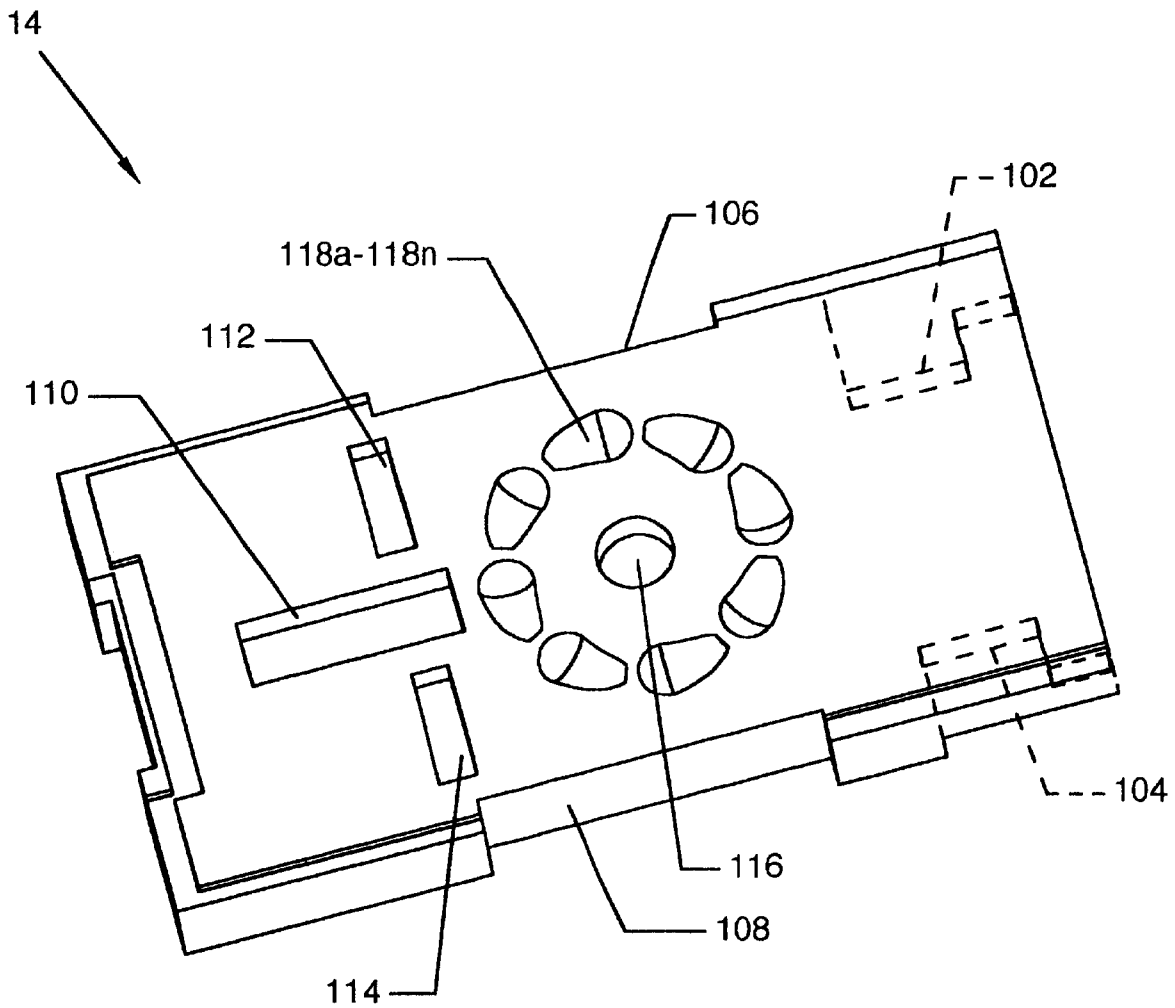
FIG. 7 illustrates an inverted isometric view of the enclosure top.

FIG. 7 illustrates an inverted isometric view of the enclosure top 14, where all numerals correspond to those elements previously described. A series of detent grooves 118*a*–118*n* having ramped depth are located concentric to the circular recess 116. The balls 66*a* and 66*b* which align to the upper region of spring bores 152 and 154 on the upper side of the cam 54 align in the deepest region of opposing detent grooves 118*a*–118*n* to provide for detented orientation of the cam 54. Ramping of the detent grooves 118*a*–118*n* provides for easy and reduced force exit of the balls 66*a* and 66*b* during repositioning of the cam 54 by the solenoid 16.

Figure 8:
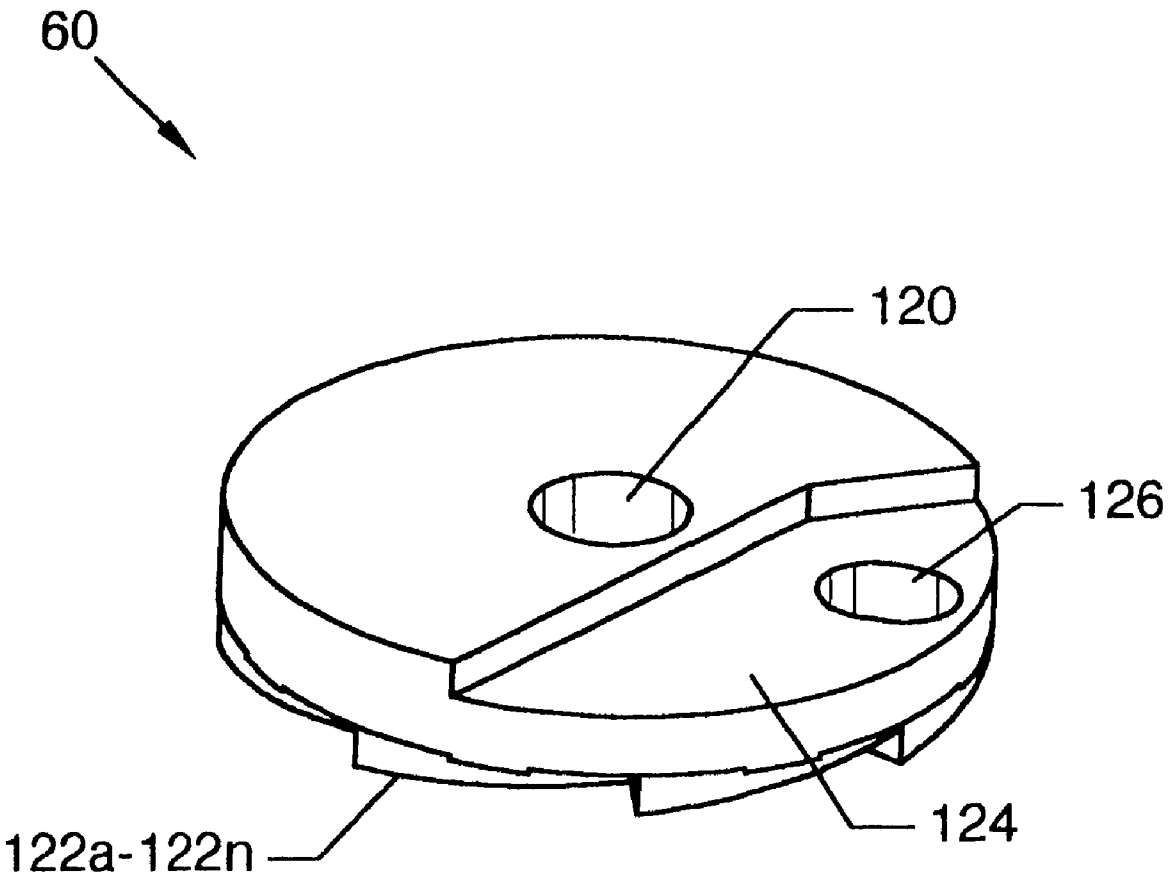
FIG. 8 illustrates an inverted isometric view of the cam driver.

FIG. 8 illustrates an inverted isometric view of the cam driver 60, where all numerals correspond to those elements previously described. Shown in particular is the recessed portion 124 and the engagement hole 126. The recessed portion 124 provides for accommodation of the cam driver arm 56.

Figure 9:
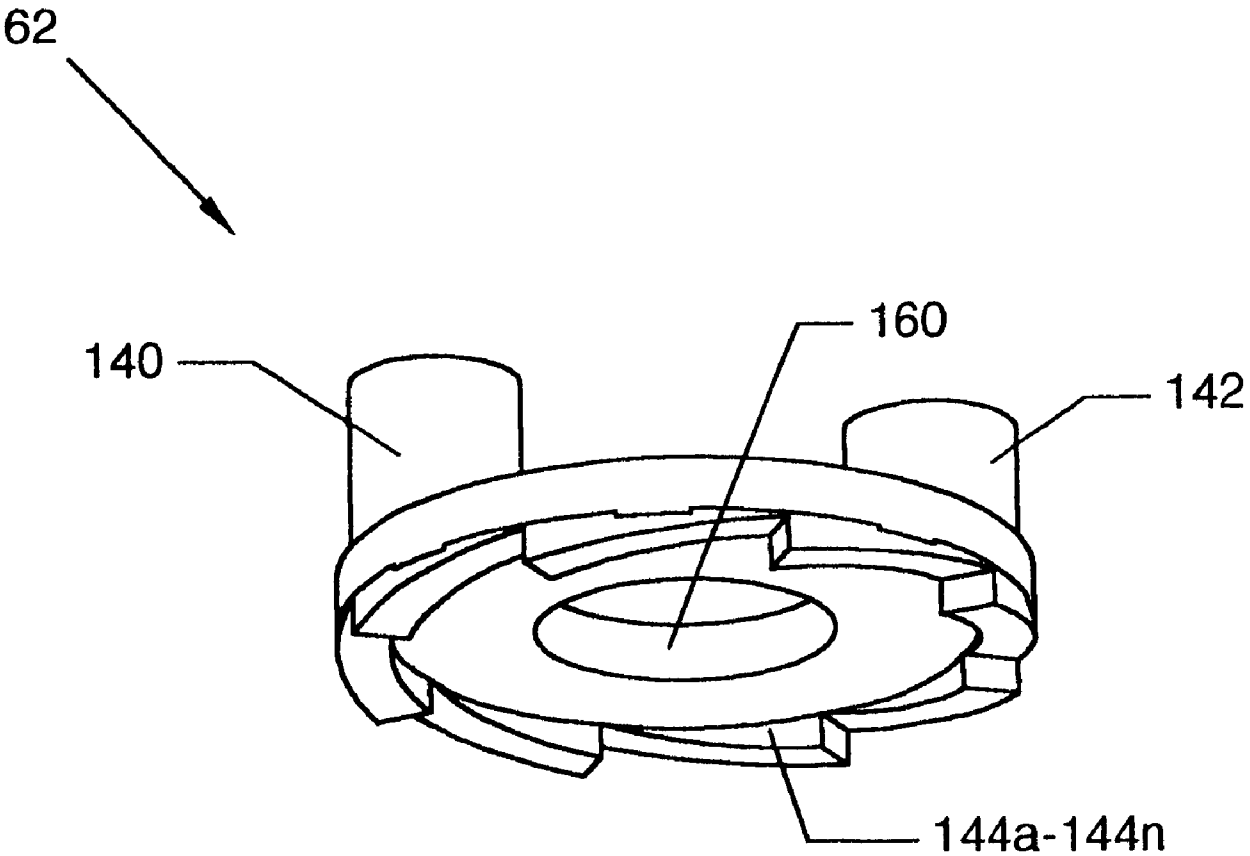
FIG. 9 illustrates an isometric view of the carrier driver.

FIG. 9 illustrates an isometric view of the carrier driver 62, where all numerals mentioned previously correspond to those elements previously described. The carrier driver 62 includes vertically aligned cylindrical spring mounts 140 and 142 extending from its top surface for mounting of the lower ends of the springs 64*a* and 64*b* and also includes a plurality of ratchet teeth 144*a*–144*n* located along and extending downwardly from the bottom surface. Also included is a centrally located locator hole 160 which is incorporated for accommodation of the annular centering extension 148 extending downwardly from the cam 54. Such accommodation provides for vertical alignment of the cam 54 with and over and about the carrier driver 62.

FIG. 10 illustrates an inverted isometric view of the cam 54, where all numerals mentioned previously correspond to those elements previously described. Shown in particular is the annular centering extension 148 and an annular space 162 located about and between the annular centering extension 148 and the cam lobes 146*a*–146*n*. The annular space 162 is also bounded by a planar and circular annular surface 164. The annular space 162 accommodates the body of the carrier driver 62. Opposing bores 166 and 168 extend vertically through the body of the cam 54 from the circular annular surface 164 to concentrically meet and align with the spring bores 152 and 154, respectively. Opposing bores 166 and 168 accommodate spring mounts 140 and 142 of the carrier driver 62 of FIG. 9. Spring mounts 140 and 142 connectingly interface with the bores 166 and 168 so that rotational motion of the carrier driver 62, as driven by the cam driver 60, provides for corresponding rotational movement of the cam 54. The lower ends of the springs 64*a* and 64*b* align in the respective spring mounts 140 and 142 and the springs extend through the spring bores 152 and 154 where the opposing upper spring ends forcefully align with the balls 66*a* and 66*b* (FIG. 2) to force the balls 66*a* and 66*b* into the detent grooves 118*a*–118*n* (FIG. 7).

Figure 11:
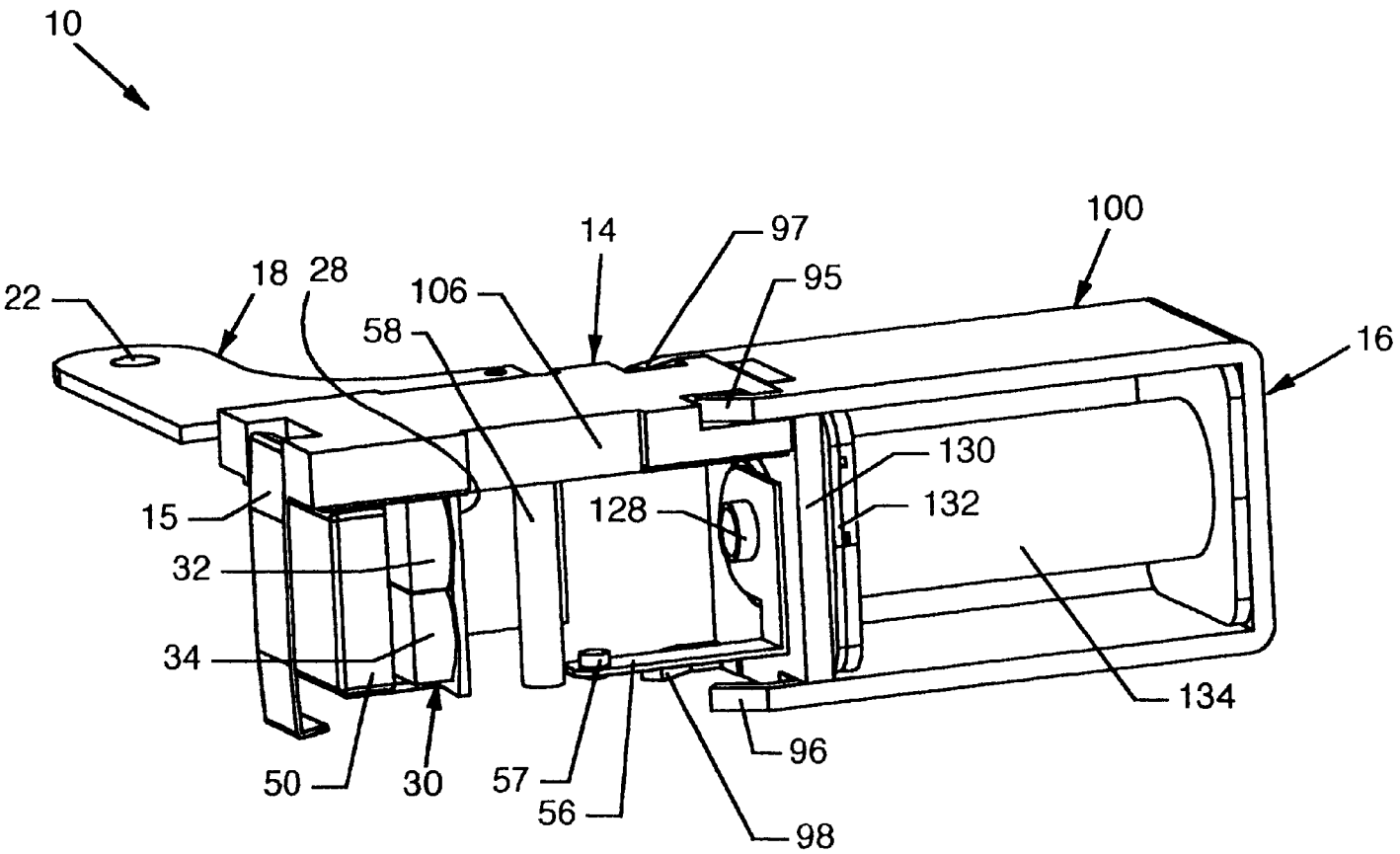
FIGS. 11–14, each illustrates a partial side view in perspective of the bi-stable battery switch where the enclosure bottom, the large switch terminal and other members have been removed for the purpose of clarity and brevity. Addition of member elements associated with a cam and actuation thereof is progressively shown throughout FIGS. 11–14.
Figure 12:
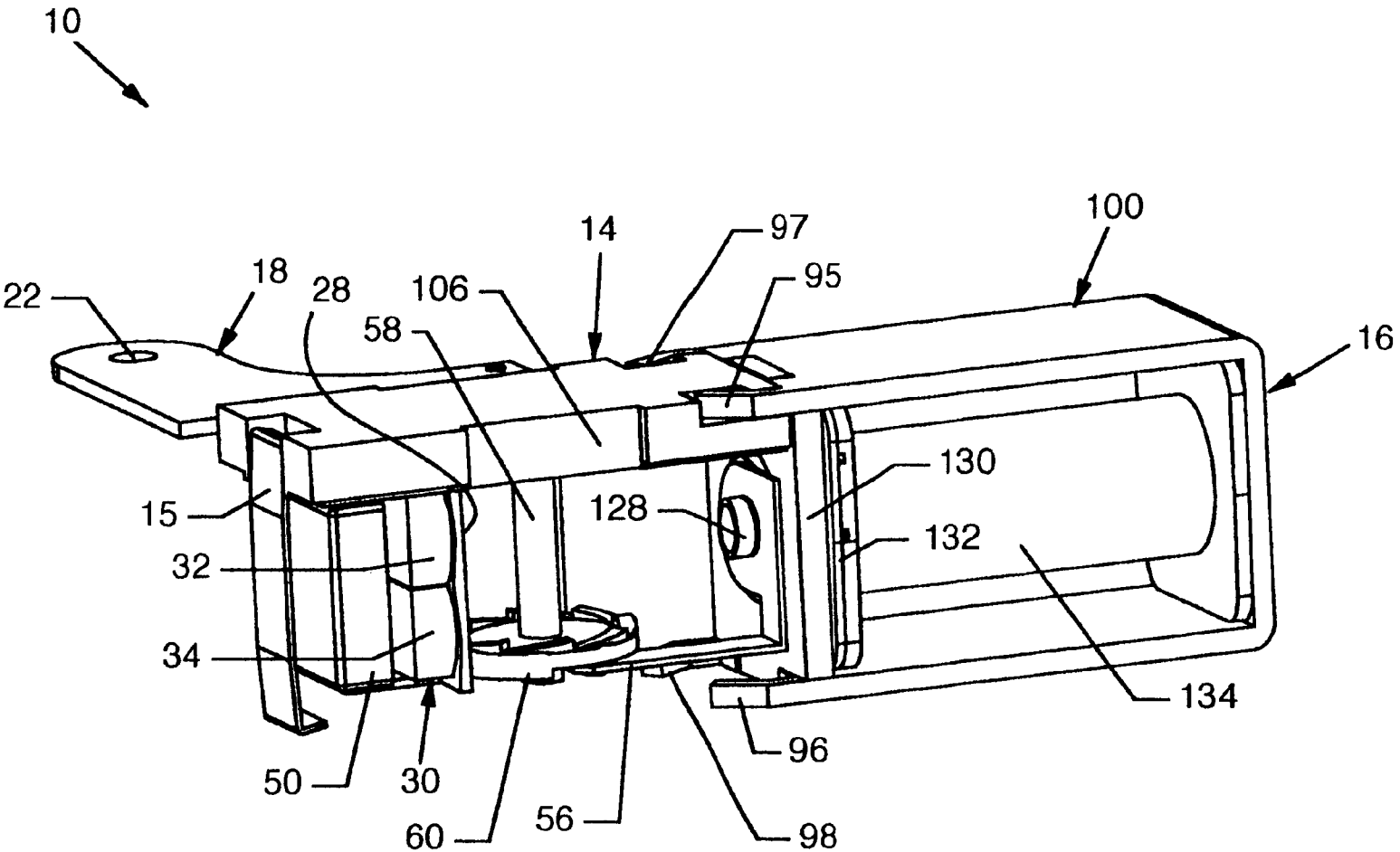
Figure 13:
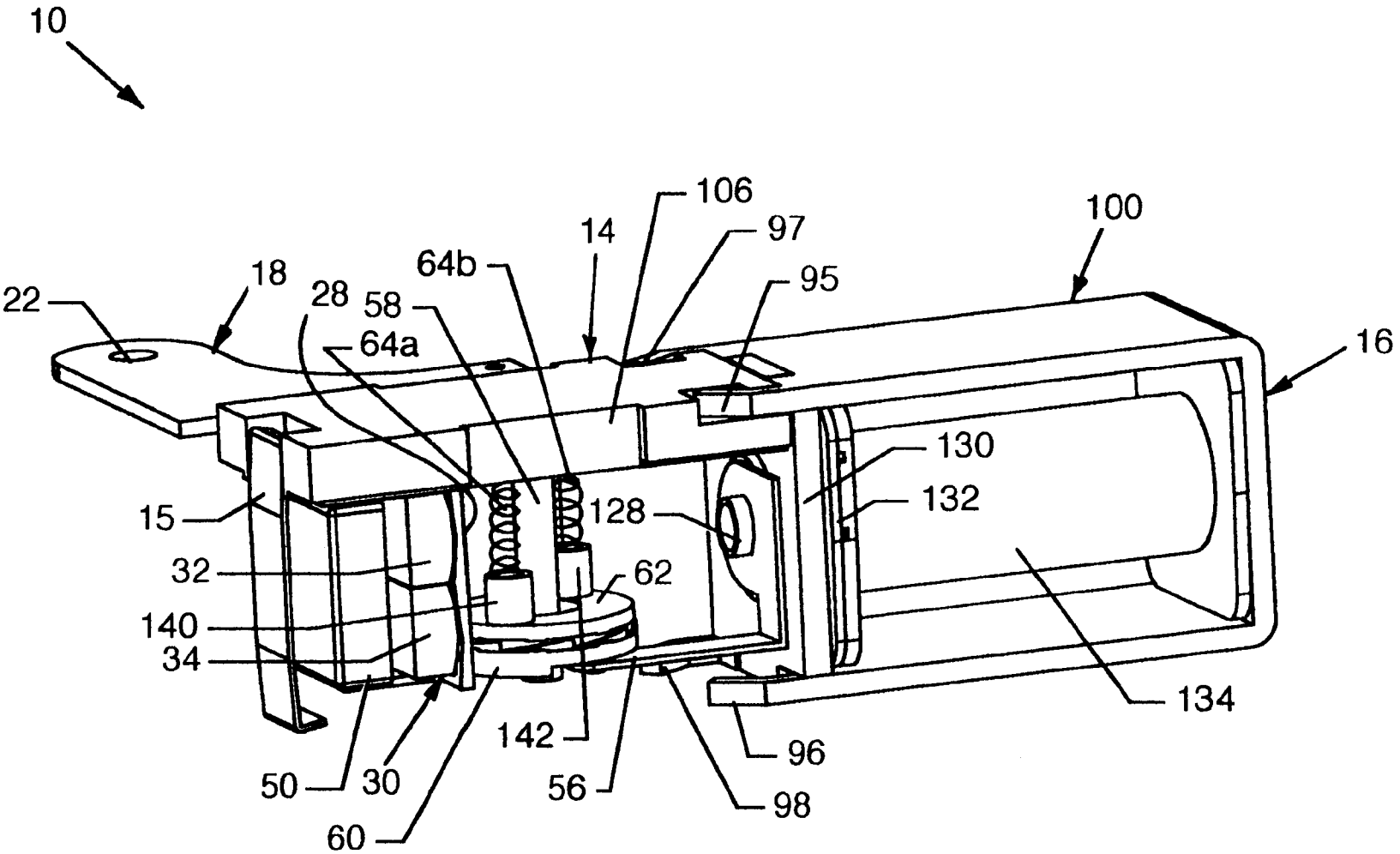
Figure 14:
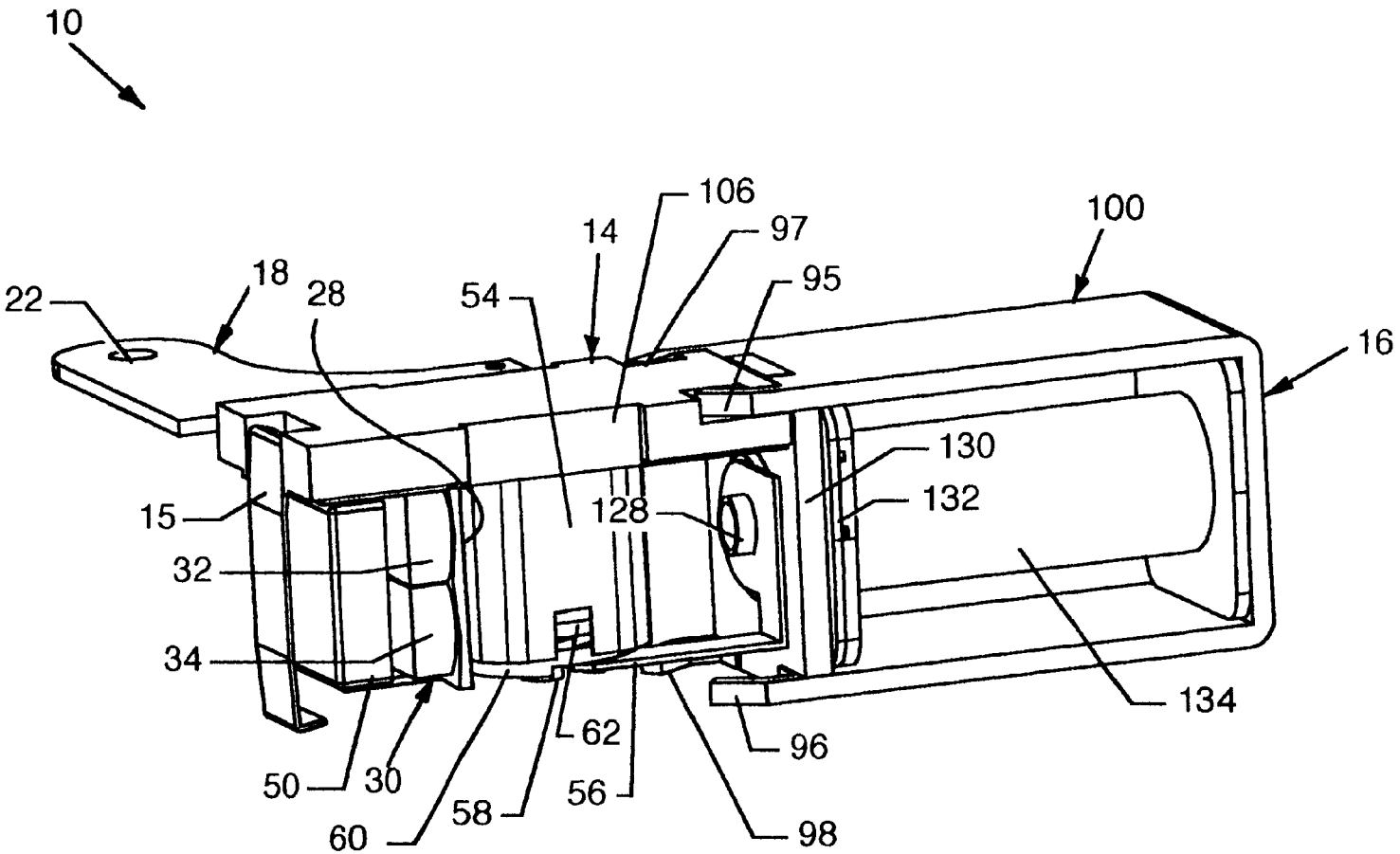

FIGS. 11–14, each illustrates a partial side view in perspective of the bi-stable battery switch 10, where all numerals correspond to those elements previously described. The enclosure bottom 12, the large switch terminal 20 and other members have been removed for the purpose of clarity and brevity. Addition of member elements, especially those elements involved with rotation of the cam 54, are progressively added as shown in the sequenced views of FIGS. 11–14. Shown especially in FIG. 11 is the cam driver arm 56 attached to the solenoid core 128 and the position of the cam driver arm 56 with relationship to the cam pivot pin 58. FIG. 12 illustrates the elements of FIG. 11 with the addition of the cam driver 60 over and about the cam pivot pin 58. The cam driver arm 56 aligns in the recessed portion 124 of the cam driver 60 and the cam driver pin 57 aligns in the engagement hole 126. Pulsed actuation of the solenoid 16 provides for stepped counterclockwise rotary motion of the cam driver 60 about the cam pivot pin 58, as previously described. FIG. 13 illustrates the elements of FIG. 12 with the addition of the carrier driver 62 and the springs 64*a* and 64*b* extending vertically from the spring mounts 140 and 142, respectively. Particularly shown is the engagement of the cam driver 60 with the carrier driver 62 where ratcheting clutch engagement occurs with actuation of the solenoid 16, as previously described. FIG. 14 illustrates the elements of FIG. 13 with the addition of the cam 54 over and about the cam pivot pin 58. Cam 54 is shown in the position calling for a continuous circuit through the bi-stable battery switch 10, or in other words, none of the cam lobes 146*a*–146*n* is in direct contact with the cam surfaces 40 on the upper and lower bus bars 32 and 34, respectively; and the springs 52*a*–52*n* residing in the rectangular spring holder 50 urge the upper and lower bus bars 32 and 34 into intimate physical and electrical contact with the contact 28 as well as the contact 26 (not illustrated).

MODE OF OPERATION

Figure 15:
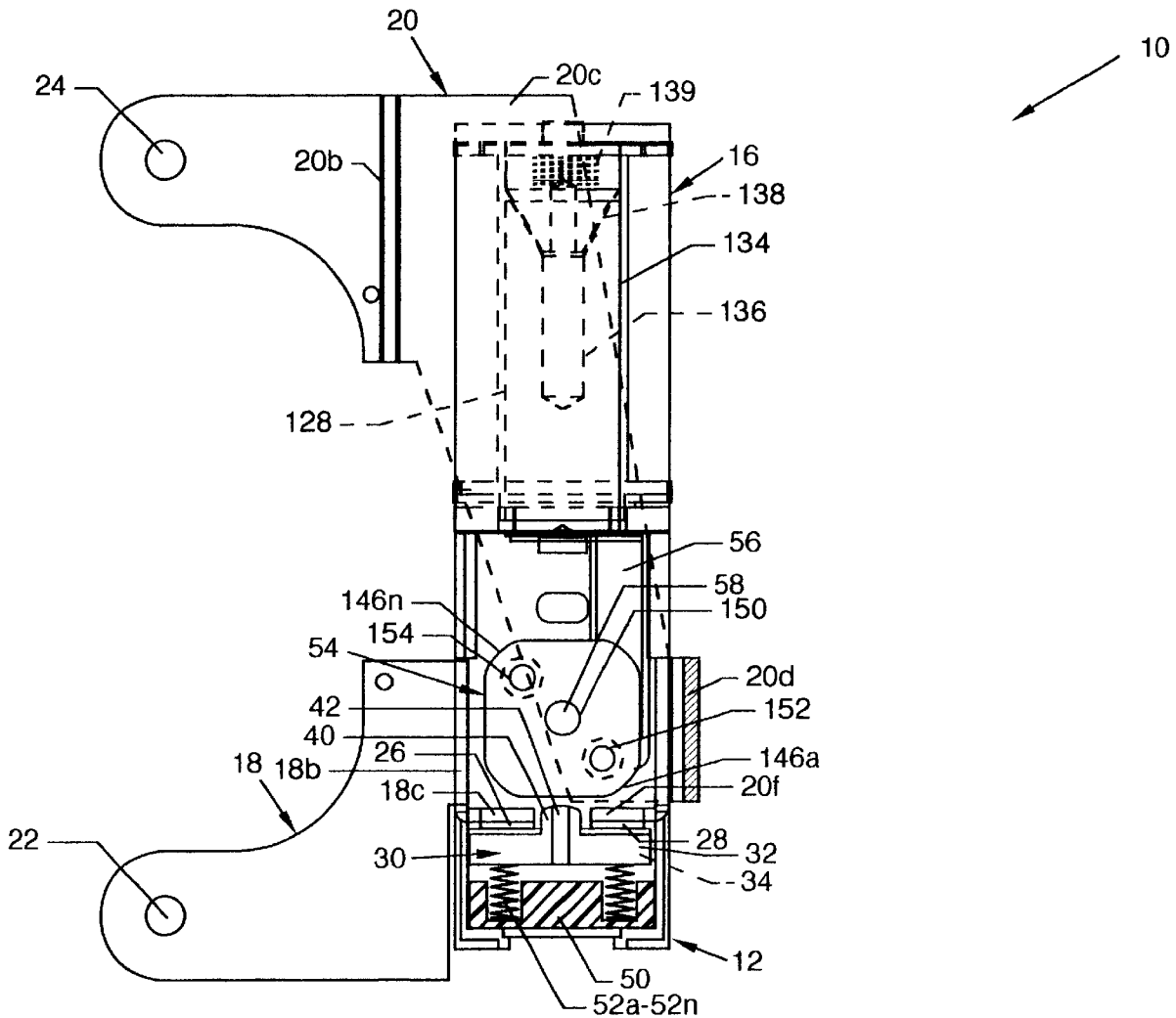
FIGS. 15 and 16 illustrate a cross sectional top view through the large switch terminal U-shaped structure of the bi-stable battery switch where the enclosure top has been removed and where a portion of the horizontally oriented planar structure of the large switch terminal is shown in dashed lines. Also shown is the relationship of the vertically oriented cam which either intimately engages, urges and forces movement of the bifurcated contact assembly to interrupt electrical contact or which is withdrawn from intimate contact with the bifurcated contact assembly to allow spring forces to urge and force the bifurcated contact assembly into electrical contact across contacts of the switch; and, FIG. 17 illustrates the incorporation of the present invention, the bi-stable battery switch, into the top portion of a storage battery such as used in an automobile or in a variety of other objects.
Figure 16:
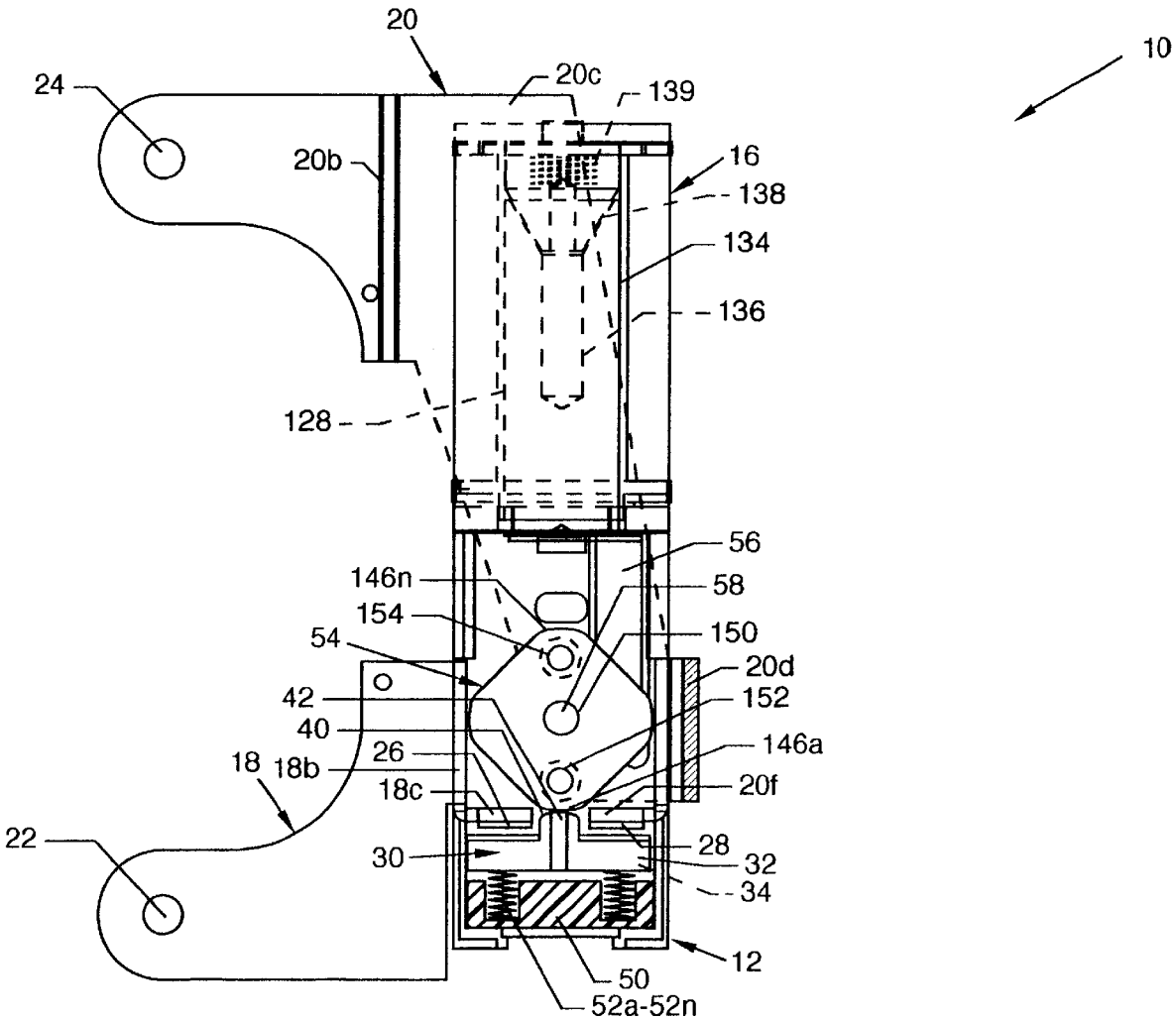

FIGS. 15 and 16 best illustrates the mode of operation of the bi-stable battery switch 10, the present invention, where all numerals correspond to those elements previously described. FIGS. 15 and 16 illustrate a cross sectional top view through the large switch terminal 20 U-shaped structure 20*d* of the bi-stable battery switch 10 where the enclosure top 14 has been removed and where a portion of the horizontally oriented structure 20*c* of the large switch terminal 20 is shown in dashed lines. FIG. 15 illustrates the bi-stable battery switch 10 in the conducting mode where the cam lobes 146*a*–146*n* of the cam 54 have been rotationally positioned by pulsing of the solenoid 16 and are not directly influencing or in contact with the cam surfaces 40 of the stacked upper and lower bus bars 32 and 34 comprising the bifurcated contact assembly 30. The plurality of springs 52*a*–52*n* in the rectangular spring holder 50 are in direct contact with the rear surfaces of the stacked upper and lower bus bars 32 and 34 to directly urge and force contact of the stacked upper and lower bus bars 32 and 34 across the contacts 26 and 28, thus completing the through electrical contact across and between the small switch terminal 18 and the large switch terminal 20 to make battery power available for a vehicle or other object. FIG. 16 illustrates the bi-stable battery switch 10 in the non-conducting mode where the cam 54 has been rotated by pulsing of the solenoid 16 to overcome the force of the plurality of springs 52*a*–52*n* to rotationally position one of the cam lobes 146*a*–146*n* of the cam 54 into direct contact with both of the cam surfaces 40 of the stacked upper and lower bus bars 32 and 34, thereby repositioning the stacked upper and lower bus bars 32 and 34 to interrupt contact of the stacked upper and lower bus bars 32 and 34 across the contacts 26 and 28, thus terminating the electrical contact across and between the small switch terminal 18 and the large switch terminal 20. Each time the solenoid 16 is pulsed by actuation of a hand held remote signaling device, electrical contact across the bi-stable battery switch 10 is made or broken to supply or interrupt supply voltage from a host battery. Although both positionable bus bars 32 and 34 are springingly and simultaneously urged toward and into intimate dual contact with the stationary and wide contacts 26 and 28 located on the small and large switch terminals 18 and 20, one positionable bus bar precedes, in a very short time span, the adjoining positionable bus bar and picks up the arcing load in contacting the stationary and wide contacts 26 and 28 of the small and large switch terminals 18 and 20 only to be closely followed by the remaining positionable bus bar which in contacting the stationary and wide contacts 26 and 28 of the small and large switch terminals 18 and 20 picks up the current load. Conversely, when contact is broken by rotational repositioning of the cam 54, one of the positionable bus bars 32 or 34 leads, in a very short time span, the adjoining positionable bus bar and releases the load current in breaking the contact across the stationary and wide contacts 26 and 28 of the small and large switch terminals 18 and 20 only to be closely followed by the remaining repositioning bus bar which releases the arcing load contact across the stationary and wide contacts 26 and 28 of the small and large switch terminals 18 and 20.

Figure 17:
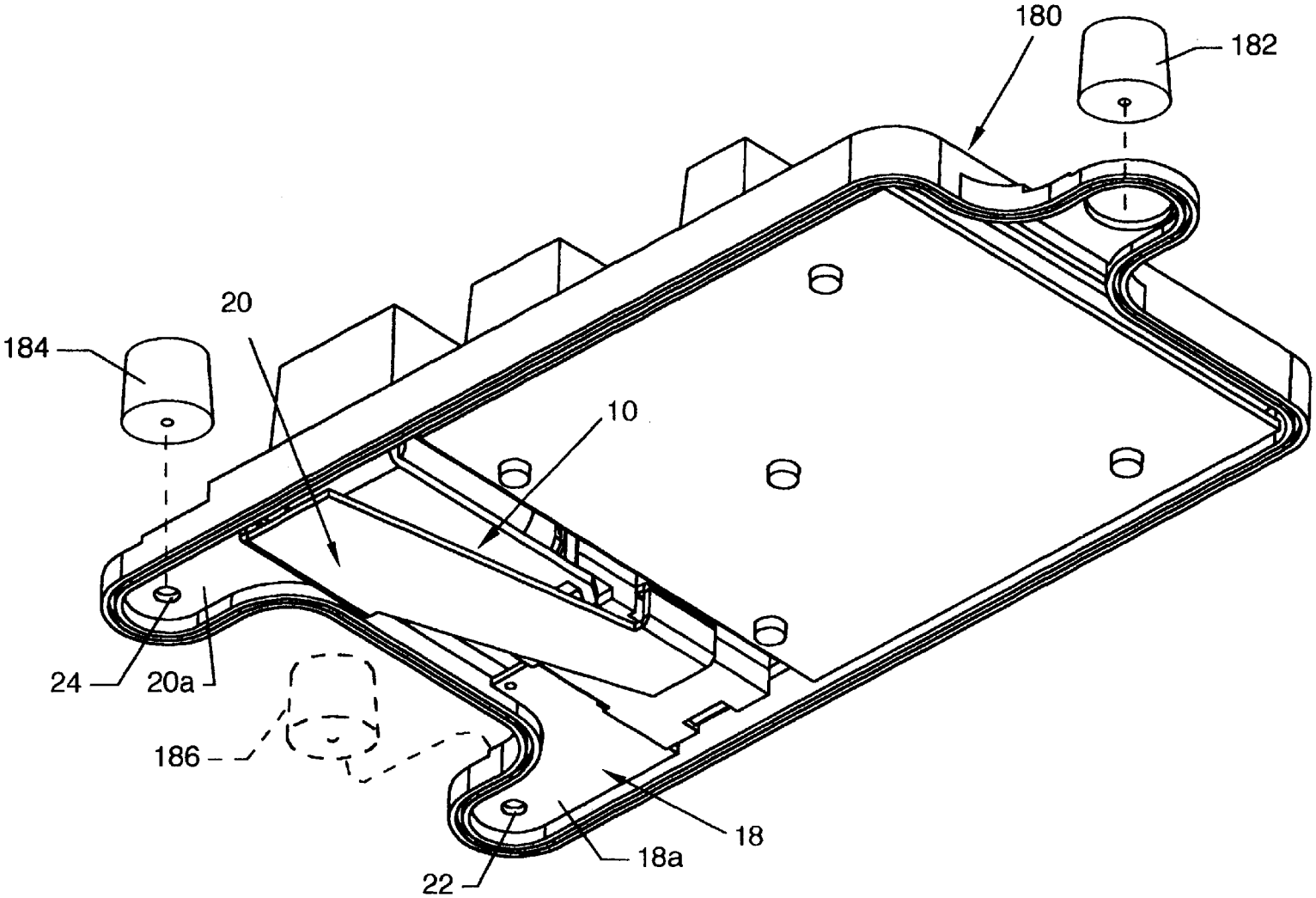

FIG. 17 illustrates the incorporation of the present invention, the bi-stable battery switch 10, into the top portion 180 of a storage battery such as used in an automobile or in a variety of other objects. A negative terminal 182 would attach to the negative plates (not illustrated) of the storage battery, and, for purposes of example and illustration, another terminal 184, a switched positive terminal, would connect to the large switch terminal 20 at the horizontally oriented planar structure 20*a* utilizing attachment hole 24. The small switch terminal 18 would connect to the positive plates of the storage battery utilizing the horizontally oriented planar structure 18*a* at attachment hole 22. In the alternative, another terminal 186 could attach to the attachment hole 22 if it is desired to have limited battery power available for other items such as burglar alarms or other accessories not related to disabling the delivery of battery power to a vehicle.

BI-STABLE BATTERY SWITCH
PARTS LIST

| | |
|---|---|
| 10 | bi-stable battery switch |
| 12 | enclosure bottom |
| 14 | enclosure top |
| 15 | clip |

-continued

BI-STABLE BATTERY SWITCH
PARTS LIST

| | |
|---|---|
| 16 | solenoid |
| 18 | small switch terminal |
| 18a | horizontally oriented planar structure |
| 18b | vertically oriented planar structure |
| 18c | contact mounting pad |
| 20 | large switch terminal |
| 20a | horizontally oriented planar structure |
| 20b | vertically oriented planar structure |
| 20c | horizontally oriented planar structure |
| 20d | U-shaped structure |
| 20e | vertically oriented planar structure |
| 20f | contact mounting pad |
| 22 | hole |
| 24 | attachment hole |
| 26 | contact |
| 26a-d | surfaces |
| 28 | contact |
| 28a-d | surfaces |
| 30 | bifurcated contact assembly |
| 32 | upper bus bar |
| 34 | lower bus bar |
| 36 | arc-shaped contact |
| 38 | arc-shaped contact |
| 40 | cam surface |
| 42 | guide bar |
| 44 | planar surface |
| 46 | upper contact guide |
| 48 | lower contact guide |
| 50 | rectangular spring holder |
| 52a-n | springs |
| 54 | cam |
| 56 | cam driver arm |
| 57 | cam driver pin |
| 58 | cam pivot pin |
| 60 | cam driver |
| 62 | carrier driver |
| 64a | spring |
| 64b | spring |
| 66a | ball |
| 66b | ball |
| 68 | bottom |
| 70 | end |
| 72 | side, left |
| 72a | cutout |
| 74 | side, right |
| 74a | cutout |
| 76 | channeled recess |
| 78 | circular recess |
| 80 | elongated recess |
| 82 | circular recess |
| 84 | solenoid core stop |
| 86 | rectangular recess |
| 88 | rectangular recess |
| 90 | rectangular recess |
| 92 | capturing slot |
| 94 | capturing slot |
| 95 | tab |
| 96 | tab |
| 97 | tab |
| 98 | tab |
| 100 | framework |
| 102 | capturing slot |
| 104 | capturing slot |
| 106 | recess |
| 108 | recess |
| 110 | rectangular recess |
| 112 | rectangular recess |
| 114 | rectangular recess |
| 116 | circular recess |
| 118a-n | detent grooves |
| 120 | hole |
| 122a-n | ratchet teeth |
| 124 | recessed portion |
| 126 | engagement hole |
| 128 | solenoid core |
| 130 | pole face |

-continued

| BI-STABLE BATTERY SWITCH PARTS LIST | |
|---|---|
| 132 | spacer |
| 134 | bobbin |
| 136 | guide pin |
| 138 | core stud assembly |
| 139 | spring |
| 140 | spring mount |
| 142 | spring mount |
| 144a-n | ratchet teeth |
| 146a-n | cam lobes |
| 148 | annular centering extension |
| 150 | pivot hole |
| 152 | spring bore |
| 154 | spring bore |
| 156 | channel |
| 158 | smooth surface |
| 160 | locator hole |
| 162 | annular space |
| 164 | circular annular surface |
| 166 | bore |
| 168 | bore |
| 180 | battery top |
| 182 | negative terminal |
| 184 | positive terminal |
| 186 | terminal |

Various modifications can be made to the present invention without departing from the apparent scope hereof.

It is claimed:

1. A bi-stable switch, preferably for internal use within a remotely switchable storage battery, or, in the alternative, for external use with a battery, comprising:

a. a first terminal having a first dual contact;

b. a second terminal having a second dual contact;

c. a bifurcated contact assembly including first and second bus bars each having first and second contact surfaces for engaging across said first and second dual contacts, said first and second bus bars being movable between a circuit making position wherein said first and second bus bars make contact with said first and second dual contacts, the first bus bar to make contact assuming the arcing load and the second bus bar to make contact assuming the current load, and a circuit breaking position wherein said first and second bus bars break contact with said first and second dual contacts, the first bus bar to break contact breaking the current load and the second bus bar to break contact breaking the arcing load; and, d. a cam rotationally movable in increments to cause said first and second bus bars to move sequentially from one to the other of said circuit making and circuit breaking positions.

2. The bi-stable switch as defined in claim 1, and further comprising a solenoid coupled to said cam, said solenoid when pulsed causing said cam to rotate one increment per pulse.

3. The bi-stable switch as defined in claim 1, and further including a cam driver coupled to said cam, a cam driver arm connected to said cam driver, and a solenoid coupled to said cam driver arm, said solenoid when pulsed moving said cam driver arm which in turn moves said cam driver which in turn moves said cam.

4. The bi-stable switch as defined in claim 1, wherein said cam is rotationally movable in increments of forty-five degrees.

5. A bi-stable switch, preferably for internal use within a remotely switchable storage battery, or, in the alternative, for external use with a battery, comprising:

a. a first terminal having a first dual contact;

b. a second terminal having a second dual contact;

c. a bifurcated contact assembly including first and second bus bars each having first and second contact surfaces for engaging across said first and second dual contacts, said first and second bus bars being movable between a circuit making position wherein said first and second bus bars make contact with said first and second dual contacts, the first bus bar to make contact assuming the arcing load and the second bus bar to make contact assuming the current load, and a circuit breaking position wherein said first and second bus bars break contact with said first and second dual contacts, the first bus bar to break contact breaking the current load and the second bus bar to break contact breaking the arcing load;

d. a solenoid;

e. a cam spaced from said solenoid, said cam being located adjacent to said first and second bus bars and being movable into and out of engagement with said first and second bus bars, said cam when in engagement with said first and second bus bars placing said first and second bus bars in the circuit breaking position, and said cam when out of engagement with said first and second bus bars placing said first and second bus bars in the circuit making position; and, f. a linkage assembly connected between said cam and said solenoid for moving said cam into and out of engagement with said first and second bus bars upon pulsing of said solenoid.

6. The bi-stable switch as defined in claim 5, wherein said linkage assembly includes a cam driver coupled to said cam and a cam driver arm coupled to said cam driver and to said solenoid.

* * * * *